US008361170B2

(12) United States Patent
Martin

(10) Patent No.: US 8,361,170 B2
(45) Date of Patent: Jan. 29, 2013

(54) USES OF EMULSIFYING AGENTS

(75) Inventor: David William Martin, Liverpool (GB)

(73) Assignee: Palox Limited, Limassol (CY)

( * ) Notice: Subject to any disclaimer, the term of this patent is extended or adjusted under 35 U.S.C. 154(b) by 438 days.

(21) Appl. No.: 12/367,526

(22) Filed: Feb. 8, 2009

(65) Prior Publication Data

US 2009/0300969 A1 Dec. 10, 2009

Related U.S. Application Data

(62) Division of application No. 12/161,565, filed on Sep. 14, 2008.

(30) Foreign Application Priority Data

Jan. 20, 2006 (GB) ..... 0601143.1

(51) Int. Cl.
*C10L 1/18* (2006.01)
*C10L 1/22* (2006.01)

(52) U.S. Cl. ..... 44/301; 44/302; 508/551; 508/555; 508/579

(58) Field of Classification Search ..... 44/301, 44/302; 508/551, 555, 579
See application file for complete search history.

(56) References Cited

FOREIGN PATENT DOCUMENTS

WO WO-9850139 * 11/1998

* cited by examiner

*Primary Examiner* — Cephia D Toomer
(74) *Attorney, Agent, or Firm* — Gomez Int'l Patent Office, LLC

(57) ABSTRACT

One or more stable, clear, water-in-fuel microemulsion-forming surfactants may be used in a liquid fuel or oil which is immiscible with water to:

a) scavenge free-water which exists in or is introduced into the liquid fuel or oil thereby to render or retain the liquid fuel or oil in a usable state; and/or b) inhibit the growth of aquatic micro-organisms in the liquid fuel or oil when the fuel or oil becomes contaminated with free-water thereby to retain the liquid fuel or oil in a usable state.

6 Claims, No Drawings

USES OF EMULSIFYING AGENTS

CROSS-REFERENCE TO RELATED APPLICATIONS

This application is a divisional of and claims priority to pending U.S. patent application Ser. No. 12/161,565 filed 19 Jul. 2008, entitled Water-In-Oil Emulsions, Methods and Uses of Emulsifying Agents.

FIELD OF THE INVENTION

The present invention concerns the protection of liquid fuels and oils, such as liquid fuels typically used in engines employed to provide motive power in vehicles, such as automobiles, trucks, trains and motorbikes, and in craft, such as ships, boats and airplanes, and in other engines such as those employed to provide power to static units e.g. generators, compressors, etc, liquid fuels typically used for burning in power stations and heating systems, e.g. fuel oils, and oils employed in lubricating mechanical parts and hydraulic systems. In particular, the present invention is concerned with the protection of such liquid fuels and oils from the deleterious effects of contamination by water, such as the effect on engines caused by the presence of water as a separate phase in a fuel, or the growth of microorganisms in fuels or oils which become contaminated with water.

The present invention also concerns compositions and a method for their preparation. More particularly, though not exclusively, the present invention concerns water-in-oil emulsions, suitable for use as a fuel or lubricant, and their preparation. In particular, the present invention concerns clear aqueous compositions which comprise at least 60 wt % of an oil selected from fuel oils, lubricating oils and mixtures thereof, which compositions are useful as a fuel, coolant or lubricant and have improved stability and lubricity properties, such as water-in-oil emulsions wherein the average droplet size of the water phase in the oil phase is no greater than 0.1 μm, and their preparation.

BACKGROUND OF THE INVENTION

Liquid fuels and oils often become contaminated with water when ambient water, such as from condensation formed within a vented storage tank, is mixed with the fuel/oil. This may give rise to a liquid mixture comprising separate, visible phases of fuel/oil and water, thus rendering the liquid fuel/oil unsuitable for application. This problem is particularly significant with fuels or oils stored over a long period of time. Where a fuel or oil is contained within a storage tank which is vented to the atmosphere, ambient temperature changes, such as between day and night, can act to effectively pump atmospheric air, containing water vapour, in and out of a head space above the stored fuel/oil. Over a number of temperature change cycles, for example over a number of hot days and cold nights, such pumping, combined with condensation of the water vapour, can give rise to the accumulation of water within the tank which may exist as a separate phase within the fuel/oil. The removal of water formed in the fuel tank of a powered water craft left unattended over a winter period is a known problem. Further, besides potentially rendering a fuel/oil unsuitable for use, such as in a combustion process, the presence of such accumulated water may provide an environment for the growth of micoorganisms, such as bacteria, funghi, protazoa and the like. Such growth may give rise to formation of a sludge in a stored fuel/oil and thus also render it unsuitable for normal use. The removal of a sludge from a fuel/oil storage tank is known to be a very significant problem in the bulk storage of liquid fuels/oils, such as on a tank farm associated with an oil refinery.

It is an object of the present invention to protect a liquid fuel or oil from contamination by water, which contamination may give rise to a two phase fuel/oil and water mixture and/or to the growth of microorganisms.

It is another object of the present invention to render suitable for application a liquid fuel or oil which has become contaminated with water.

The use of water as an additive in fuel oils to reduce emissions of pollutants and to aid incorporation of other beneficial performance additives has been known for many years. The use of water as an additive in lubricant oils to improve the cooling properties of e.g. cutting oils has also been known for many years. Water is incorporated into the fuel and lubricant oils in the form of a water-in-oil emulsion.

Water-in-oil emulsions formed with a large water droplet size tend to have a milky appearance. These emulsions require a number of secondary additives such as corrosion inhibitors and bactericides to overcome problems associated with addition of the water phase. These macroemulsions, due to their large water droplet size, also tend to exhibit instability that leads to oil/water separation. Naturally, this is unwelcome as it may lead to problems with not only machine failure but also problems with ignition e.g. in a diesel-engine.

Cutting oils, based on water-in-oil emulsions, have been used to lubricate machine tools. The excellent coolant property of the water has been demonstrated to improve the life of the tool. However, the incorporation of water coupled with the instability of macroemulsions give rise to other problems, such as the lubricity of the oil, which is decreased with addition of water thereby affecting the surface finish of the metal.

Water-in-oil emulsions formed with an average water droplet size of less than 0.1 μm (hereafter referred to as "microemulsions") are translucent. This small droplet size not only gives an appearance which is more aesthetically pleasing to the user but also offers several major advantages over the larger droplet-sized systems. These translucent or clear microemulsions tend to be more stable than the larger droplet sized milky macroemulsions, as the water droplets remain in dispersion longer and do not readily undergo macro oil/water phase separation. The small droplet size also appears to negate the need for both corrosion inhibitors and bactericides.

U.S. Pat. No. 3,095,286 (Andress et al) discloses the problem of water accumulation in fuel oil storage tanks, resulting from the "breathing" of storage vessels, presenting a problem of rusting. To inhibit sedimentation, screen clogging and rusting in fuel oil compositions during storage it is disclosed to use a compound selected from a phthalamic acid, a tetrahydrophthalamic acid, a hexahydrophthalamic acid and a nadamic acid and their salts of primary amines having between 4 and 30 carbon atoms per molecule as an addition agent to the fuel oil. There is no disclosure of the addition agents forming water-in-oil microemulsions of the fuel oil.

U.S. Pat. No. 3,346,494 (Robbins et al) discloses the preparation of microemulsions employing a selected combination of three microemulsifiers, specifically a fatty acid, an amino alcohol and an alkyl phenol.

FR-A-2373328 (Grangette et al) discloses the preparation of microemulsions of oil and salt water by employing sulphur containing surfactants.

U.S. Pat. No. 3,876,391 (McCoy et al) discloses a process for preparing clear, stable water-in-petroleum microemulsions, which may contain increased quantities of water-soluble additives. The microemulsions are formed by use of both a gasoline-soluble surfactant and a water-soluble surfactant. The only water-soluble surfactants employed in the worked examples are ethoxylated nonylphenols.

U.S. Pat. No. 4,619,967 (Emerson et al) discloses the use of water-in-oil emulsions for emulsion polymerisation processes.

U.S. Pat. No. 4,770,670 (Hazbun et al) discloses stable water-in-fuel microemulsions employing a cosurfactant combination of a phenyl alcohol and an ionic or nonionic surfactant.

U.S. Pat. No. 4,832,868 (Schmid et al) discloses surfactant mixtures useful in the preparation of oil-in-water emulsions. There is no disclosure of any water-in-oil microemulsion comprising at least 60 wt % oil phase.

U.S. Pat. No. 5,633,220 (Cawiezel) discloses the preparation of a water-in-oil emulsion fracturing fluid including an emulsifying agent sold by ICI under the trademark Hypermer (Hypermer emulsifying agents are not disclosed as being $C_6$-$C_{15}$ alcohol ethoxylates or mixtures thereof).

Mixtures of $C_6$-$C_{15}$ alcohol ethoxylates are commercially available surfactants normally sold for use in the preparation of e.g. washing detergents.

WO-A-9818884 discloses water-in-fuel microemulsions, including examples of such emulsions comprising a $C_8$ alcohol ethoxylate, with 6 EO groups, mixed with a polyglyceryl-4-monooleate, and mixtures of $C_9$-$C_{11}$ alcohol ethoxylates mixed with either polyglyceryl oleates linear alcohols or POE sorbitan alcohols. The presence of the polyglyceryl oleates and POE sorbitan alcohols tend to have detrimental effects on the viscosity properties of the emulsions which, in turn, has a consequential detrimental effect on the lubricity properties of the emulsion.

WO-A-9850139 discloses a water-in-oil microemulsion, including a surfactant mixture comprising a fatty acid amine ethoxylate, a $C_6$-$C_{15}$ alcohol ethoxylate and optionally a tall oil fatty acid amine. The water-in-oil microemulsion may be an industrial lubricant.

WO-A-0053699 discloses a water-in-oil microemulsion, including emulsifying agents comprising a $C_6$-$C_{15}$ alcohol ethoxylate, an amine ethoxylate and a polyisobutylsucciniide or sorbitan ester. The water-in-oil microemulsion may be a fuel.

EP-A-1101815 discloses a fuel, particularly for diesel engines, in microemulsion form, comprising a liquid fuel, an emulsifier and an emulsive agent, the emulsive agent having an HLB value higher than 9.

U.S. Pat. No. 6,716,801 discloses a stable, clear water-in-oil microemulsion consisting of from about 5 to 40 wt % aqueous phase and from about 95 to about 60 wt % non-aqueous phase. The microemulsion includes from about 5 to 30 wt % emulsifiers consisting of i) a mixture of $C_6$-$C_{15}$ alcohol ethoxylates each comprising from 2 to 12 EO groups, ii) 0 to about 25 wt % polyisobutylsuccinimide and/or sorbitan ester, and iii) 0 to about 90 wt % amine ethoxylate. The microemulsion is described to be useful as a fuel and/or lubricant/coolant.

The water-in-oil emulsions previously sold for use as fuels and lubricants generally contain surfactants that, due to incomplete combustion, form combustion by-products that are potentially harmful to the environment, such as nitrogen-, phenyl- and sulphur-containing compounds, and/or have detrimental effects on the lubricity properties. There is a continuing need therefore to provide new and/or improved fuels and lubricants that do not suffer the same problems. With this background, however, any new fuel and lubricant must also perform at least as well as the prior art fuels and lubricants. The prior art microemulsions overcome at least some of the problems associated with water-in-oil emulsion and demonstrate good performance properties. However, there is a continuing demand for microemulsions which are able to deliver good performance properties as well as overcoming the problems associated with water-in-oil emulsions.

It is another object of the present invention to provide water-in-oil microemulsions that may be used as fuels and/or lubricants and which, without loss of performance, employ surfactants that may be more environmentally acceptable than those hitherto employed in fuels. It is a further object of the present invention to provide a novel water-in-oil microemulsion that may require less surfactant than is used in conventional water-in-oil microemulsion fuels and lubricants.

As there is a tendency in the design of modern engines to employ the fuel not only as a fuel per se, but also as a lubricant and coolant, such as where a portion of fuel is continually recirculated between the hot engine and fuel tank, it is a further object of the present invention to provide a water-in-oil microemulsion fuel or lubricant that may demonstrate improved stability, such as thermal stability.

It is a further object of the present invention to provide a water-in-oil microemulsion fuel or lubricant that may demonstrate improved lubricity.

SUMMARY OF THE INVENTION

The present invention, in its various aspects, is as set out in the accompanying claims.

In a first aspect, the present invention provides the use of one or more stable, clear, water-in-fuel microemulsion-forming surfactants in a liquid fuel or oil immiscible with water, characterised in that said use is to:

a) scavenge free-water which exists in or is introduced into the liquid fuel thereby to render or retain the liquid fuel or oil in a usable state; and/or b) inhibit the growth of aquatic micro-organisms in the liquid fuel or oil when the fuel or oil becomes contaminated with free-water thereby to retain the liquid fuel or oil in a usable state.

In a second aspect, the present invention provides the use in a liquid fuel or oil immiscible with water of one or more surfactants, which alone or together is/are a) miscible or soluble with both the liquid fuel or oil and water and b) capable of distributing water in the liquid fuel or oil to provide a stable clear water-in-oil microemulsion, to scavenge free-water which may exist in or is introduced into the liquid fuel or oil and thereby render or retain the liquid fuel or oil in a usable state.

In a third aspect, the present invention provides the use of one or more surfactants in a liquid fuel or oil that is immiscible with water, wherein said surfactant(s) alone or together is/are a) miscible or soluble with both the liquid fuel or oil and water and b) capable of distributing water into the liquid fuel or oil to provide a stable clear water-in-oil microemulsion, to inhibit the growth of aquatic microorganisms in the liquid fuel or oil when contaminated with water and retain the liquid fuel or oil in a usable state.

In a fourth aspect, the present invention provides the use of one or more surfactants in a liquid fuel or oil which is immiscible with water, wherein said surfactant(s) alone or together is/are a) miscible or soluble with both the liquid fuel or oil and water and b) capable of distributing water in the liquid fuel or oil to provide a stable clear water-in-oil microemulsion, to retain or render the liquid fuel or oil in a usable state in the event that the liquid fuel or oil becomes contaminated with free-water.

In a fifth aspect, the present invention provides a method of scavenging free-water which exists in or is introduced into a liquid fuel or oil which is immiscible with water thereby to render or retain the liquid fuel or oil in a usable state, which method comprises:

i) adding to a substantially water-free liquid fuel or oil or to a liquid fuel or oil contaminated with free-water one or more surfactants which alone or together is/are a) miscible or soluble with both the liquid fuel or oil and water and b) capable of distributing free-water into the liquid fuel or oil to provide a stable clear water-in-oil microemulsion; and ii) allowing the at least one surfactant to mix with the liquid fuel or oil.

In a sixth aspect, the present invention provides a method for inhibiting the growth of aquatic microorganisms in a liquid fuel or oil which is immiscible with water thereby to retain the liquid fuel or oil in a usable state, which method comprises:

i) adding to a substantially water-free liquid fuel or oil or to a liquid fuel or oil contaminated with free-water one or more surfactants which alone or together is/are a) miscible or soluble with both the liquid fuel or oil and water and b) capable of distributing free-water into the liquid fuel or oil to provide a stable clear water-in-oil microemulsion; and ii) allowing the at least one surfactant to mix with the liquid fuel or oil.

The use of the first, second, third and fourth aspects and the method of the fifth and sixth aspects may be practised wherein the liquid fuel or oil is stored within a vessel having a headspace vented to the atmosphere e.g. a bulk storage tank or a fuel tank.

The term "free-water" refers to water present as a separate visible liquid phase in a two phase liquid fuel or oil and water mixture.

In the above aspects of invention, the free-water exists in or is introduced into the liquid fuel or oil as a contaminant i.e. it is not water which has been deliberately added to the liquid fuel or oil, such as water added to a liquid fuel or oil in the preparation of a water-in-oil emulsion or microemulsion. The free-water exists or is introduced as a contaminant in the liquid fuel or water when e.g. water is added to the liquid fuel or oil accidentally or inadvertently, or the water is ambient moisture such as from rain or condensation water derived from changes in humidity levels is the atmosphere whilst the liquid fuel or oil is in a tank vented to atmospheric conditions. In the above aspects of the present invention, the free-water is preferably free-water introduced into the liquid fuel oil as ambient moisture. Whilst in extreme conditions the amount of free-water which may be introduced as a contaminant could comprise 5% by weight or more of the combined weight of water and liquid fuel or oil, it will be apparent to those skilled in the art that in practice the amount of free-water contaminant will typically comprise significantly less than 5 wt % of the combined weight of free-water and liquid fuel or oil. For example, typically the amount of free-water contaminating the liquid fuel or oil will be less than 2 wt % and more typically less than 1 wt %, such as 0.1 wt % or less, by weight of the combined weight of water and liquid fuel or oil.

The term "scavenge" means to act as a scavenger and a "scavenger" is a substance added to a chemical reaction or mixture to counteract the effect of impurities, as defined in Collins English Dictionary, Fourth Edition 1998, Reprinted 1999 (twice), HarperCollins Publishers.

The terms "liquid fuel" and "oil" are herein used as substantially equivalent generic terms for liquids such as diesel; kerosene; gasoline/petrol (leaded or unleaded); paraffinic, naphthenic, heavy fuel oils, biofuels, waste oils or such as esters, poly alpha olefins; etc, and mixtures thereof. The liquid fuels most suitable for practising the present invention are the hydrocarbon fuel oils, most suitably biodiesel, bioethanol, diesel, kerosene and gasoline/petrol.

The term "liquid fuel or oil which is immiscible with water" refers to a liquid fuel or oil, such as a hydrocarbon fuel oil, that is not miscible with water at greater than about 0.5% water, preferably at greater than 0.05%, i.e. any admixture of liquid fuel and water above 0.5% separates out on standing in to two phases.

The term surfactant and microemulsion-forming surfactant as used above refer to any suitable surfactant or mixture of surfactants which is capable upon simple admixture with a mixture comprising two visible immiscible phases of a liquid fuel or oil and water of forming a water-in-oil microemulsion. Formation of the microemulsion is substantially spontaneous upon the addition at ambient temperature (e.g. 10-30° C.) of the surfactant(s) to a mixture comprising two visible immiscible phases of a liquid fuel or oil and water. Persons skilled in the art will be familiar with such surfactants or surfactant mixtures, for example as disclosed in the microemulsion prior art references mentioned above (Whilst the process of inhibiting sedimentation, screen clogging and rusting in fuel oil compositions during storage disclosed in U.S. Pat. No. 3,095,286 has not been investigated, the addition agents disclosed in U.S. Pat. No. 3,095,286 are not believed to form stable, clear, water-in-oil microemulsions upon admixture with a mixture comprising two visible immiscible phases of a liquid fuel or oil and water. Accordingly, the addition agents disclosed in U.S. Pat. No. 3,095,286 are not considered to be stable, clear, microemulsion-forming surfactants as required in the present invention. However, for the avoidance of any doubt, the expression "one or more stable, clear, water-in-fuel microemulsion-forming surfactants" as employed in the present invention excludes amic acids of formulas (1), (2), (3) and (4) and their salts of primary amines having between 4 and 30 carbon atoms per molecule as disclosed in U.S. Pat. No. 3,095,286). A suitable surfactant mixture may comprises a $C_6$-$C_{15}$ alcohol ethoxylate or a mixture of such ethoxylates and/or a fatty acid amine ethoxylate and optionally a tall oil fatty acid amine. Another suitable surfactant mixture may comprises a $C_6$-$C_{15}$ alcohol ethoxylate or a mixture of such ethoxylates and/or a fatty acid amine ethoxylate and a polyisobutylsuccininide and/or sorbitan ester. Particularly suitable stable, clear, water-in-oil microemulsion-forming surfactants are amphoteric or comprise a mixture of surfactants including at least one amphoteric surfactant. Preferred amphoteric surfactants are betaines and sulpho betaines, particularly betaines. The most preferred surfactants are the emulsifying agents herein below described.

In a seventh aspect, the present invention provides a clear aqueous composition, useful as a fuel, coolant or lubricant, comprising:

at least 60 wt % of an oil selected from fuel oils, lubricating oils and mixtures thereof, and from about 1 to about 30 wt % of emulsifying agents wherein said emulsifying agents include a fatty ($C_8$-$C_{24}$)-amido-($C_1$-$C_6$)alkyl betaine.

Though the physical nature of the clear aqueous composition of the first aspect is not fully understood, it is believed that the clear aqueous composition comprises an aqueous phase distributed within a non-aqueous phase, wherein that the aqueous phase is distributed in the non-aqueous phase in the form of droplets, possibly micelles, having a size no greater than about 0.1 μm. Accordingly, in a second aspect, the present invention provides a water-in-oil emulsion, useful as a fuel or lubricant, comprising from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 1 to about 30 wt % of emulsifying agents, and the balance to 100 wt % water, wherein said emulsifying agents include a fatty ($C_8$-$C_{24}$)-amido-($C_1$-$C_6$)alkyl betaine.

In a eighth aspect, the present invention is a method of improving the stability of a water-in-oil emulsion comprising from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 1 to about 30 wt % of emulsifying agents, and the balance to 100 wt % water, wherein said emulsifying agents include a fatty ($C_8$-$C_{24}$)-amido-($C_1$-$C_6$)alkyl betaine; wherein said method comprises mixing said oil, said emulsifying agents and said water to form a clear microemulsion.

In a ninth aspect, the present invention is a method of improving the lubricity of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 1 to about 30 wt % of emulsifying agents, and the balance to 100 wt % water, wherein said emulsifying agents include a fatty ($C_8$-$C_{24}$)-amido-($C_1$-$C_6$)alkyl betaine; wherein said method comprises mixing said oil, said emulsifying agents and said water to form a clear microemulsion.

The microemulsion of the present invention may include a fatty ($C_8$-$C_{24}$)-amido-($C_1$-$C_6$)alkyl betaine as an emulsifying agent. Preferably, the fatty ($C_8$-$C_{24}$)-amido-($C_1$-$C_6$)alkyl betaine is a fatty ($C_{10}$-$C_{20}$)-amido-($C_2$-$C_4$)alkyl betaine, more preferably a fatty ($C_{10}$-$C_{18}$)-amido-($C_3$)alkyl betaine, and most preferably a fatty ($C_{11}$-$C_{17}$)alkyl amidopropyl betaine, e.g. cocoamidopropyl betaine.

Preferably, from about 0.5 up to about 15% by wt of the emulsifying agents employed in the microemulsion is comprised of the fatty ($C_8$-$C_{24}$)-amido-($C_1$-$C_6$)alkyl betaine. More preferably the fatty ($C_8$-$C_{24}$)-amido-($C_1$-$C_6$)alkyl betaine comprises 0.5 to 8 wt % of the emulsifying agents.

In addition to the fatty ($C_8$-$C_{24}$)-amido-($C_1$-$C_6$)alkyl betaine, the microemulsion preferably includes one or more other emulsifying agents. In one embodiment, the microemulsion additionally comprises a $C_6$-$C_{15}$ alcohol ethoxylate comprising from 2 to 12 EO groups, but preferably a mixture of such alcohol ethoxylates is used. The $C_6$-$C_{15}$ alcohol ethoxylate preferably comprises from 5 to 99 wt %, more preferably 70 to 95 wt %, of the emulsifying agents. In another embodiment, the microemulsion comprises a ($C_6$-$C_{24}$)alkyl amine oxide, preferably a ($C_6$-$C_{12}$)alkyl amine oxide. The ($C_6$-$C_{24}$) alkyl amine oxide preferably comprises from 0.5 to 15 wt % of the emulsifying agents. In another embodiment, the microemulsion comprises i) a fatty ($C_8$-$C_{24}$)-amido-($C_1$-$C_6$)alkyl betaine, ii) a $C_6$-$C_{15}$ alcohol ethoxylate comprising from 2 to 12 EO groups or a mixture of such alcohol ethoxylates, preferably the mixture, and iii) a ($C_6$-$C_{24}$)alkyl amine oxide. Preferably, the emulsifying agent comprises i) about 0.5 to about 15 wt % fatty ($C_8$-$C_{24}$)-amido-($C_1$-$C_6$)alkyl betaine, ii) about 5 to about 99 wt % $C_6$-$C_{15}$ alcohol ethoxylate comprising from 2 to 12 EO groups or a mixture of such alcohol ethoxylates, preferably the mixture, and iii) about 0.5 to about 15 wt % ($C_6$-$C_{24}$)alkyl amine oxide.

In addition to emulsifying agents i) and ii) and/or iii), the microemulsion may comprise other emulsifying agents. When present, such other emulsifying agents may comprise from about 0.5 up to about 95 wt % of the emulsifying agents. Such other emulsifying agents are preferably non-ionic emulsifying agents. Examples of such other emulsifying agents useful in the present invention include fatty acid amine ethoxylates (Acid amine ethoxylates are well known to those skilled in the art and are also known as alkanolamide ethoxylates. Products useful in the present invention may be obtainable by the reaction of ethylene oxide and fatty alkanolamide or the reaction of a fatty acid and an ethoxylated amine, e.g. fatty ($C_6$-$C_{24}$)acid amine ethoxylates comprising from about 2 to 20 EO groups, examples of which include cocomonoethanolamide and cocodiethanolamide. Another example is Ciba's Albegal B product). In one embodiment, the emulsifying agent comprises i) about 0.5 to about 15 wt % fatty ($C_8$-$C_{24}$)-amido-($C_1$-$C_6$)alkyl betaine, ii) about 5 to about 98.5 wt % $C_6$-$C_{15}$ alcohol ethoxylate comprising from 2 to 12 EO groups or a mixture of such alcohol ethoxylates, preferably the mixture, iii) about 0.5 to about 15 wt % ($C_6$-$C_{24}$)alkyl amine oxide; and iv) about 0.5 to about 94 wt % other emulsifying agent, preferably non-ionic emulsifying agent, more preferably nonionic fatty ($C_6$-$C_{24}$)acid amine ethoxylates comprising from about 2 to 20 EO groups.

The total amount of emulsifying agent, expressed as active ingredient (a.i.), employed in the present invention constitutes from about 1 to about 30 wt % of the microemulsion. Preferably, the amount of emulsifying agent (a.i.) is from about 1 to about 20 wt %, more preferably from about 1 to about 10 wt % of the microemulsion.

In a further aspect of the present invention, there is provided an emulsifier composition for preparing a water-in-oil microemulsion. The emulsifier composition comprises a mixture of emulsifying agents i) and ii) and/or iii). The mixture may comprise additional emulsifying agents, such as a fatty acid amine ethoxylate. The mixtures of the present invention are very beneficial, because they may be added to any water-contaminated fuel thereby to distribute the water in the fuel and render it combustible. For example, when a diesel engine boat is left over winter with fuel in the tank, the fuel may become contaminated with water which, if permitted to enter the combustion chamber of the engine could cause considerable damage. Addition of the emulsifier composition of the invention to the water-contaminated fuel before an attempt is made to fire up the engine, enables the water to be distributed within the fuel to provide a combustible water-in-fuel emulsion which does not cause damage to the engine. Without use of the emulsifier composition, it would otherwise be necessary to carefully remove the water before firing up the engine.

In another aspect, the present invention provides the use of a fatty ($C_8$-$C_{24}$)-amido-($C_1$-$C_6$)alkyl betaine as an additive to a fuel contaminated with water to provide a water-in-fuel emulsion.

In another aspect, the present invention provides a method of starting-up an engine, such as petrol or diesel engine, fed from a fuel tank containing a fuel contaminated with water, the method comprising the following sequential steps:

a) adding a fatty ($C_8$-$C_{24}$)-amido-($C_1$-$C_6$)alkyl betaine to the fuel tank containing a water-contaminated fuel;

b) mixing the fatty ($C_8$-$C_{24}$)-amido-($C_1$-$C_6$)alkyl betaine into the water-contaminated fuel, thereby to emulsify the water in the fuel to form a water-in-fuel emulsion;

c) feeding the water-in-fuel emulsion to the engine; and d) igniting the water-in-fuel emulsion in the engine.

Where the oil is a fuel oil, the water-in-fuel microemulsions of the present invention tend to have cleaner emissions, with no phenyl- or sulphur-by-products, and demonstrate at least similar if not improved performance over the prior art fuels i.e. reduced particulate matter and NOx and improved combustion rates (leading to better fuel consumption). Surprisingly, the emulsifying agents may be used in the present is highly efficient and may be employed in lesser amounts than surfactants employed in the prior art fuels.

The use of heavier oils as, for example, machine cutting fluids can also benefit from this technology as there may be an increase in lubricity. The present microemulsions may have improved lubricity and improved combustion properties without the problems of corrosion or bacterial growth.

The microemulsions of the present invention tend to demonstrate improved stability over commercially available water-in-oil emulsions, thereby requiring less stirring in storage.

DETAILED DESCRIPTION

The present invention provides new water-in-oil microemulsions and methods for their preparation. The droplets of the water phase of the emulsion are believed to have an average droplet size of no greater than 0.1 μm. These microemulsions, without other additives, are clear or translucent emulsions. Thus, in a further aspect the present invention there is provided a mixture of emulsifying agents suitable for preparing a water-in-oil microemulsion, wherein the emulsion is a clear translucent emulsion.

Oil is a hydrocarbon feedstock and can consist of any of the following: diesel; kerosene; gasoline/petrol (leaded or unleaded); paraffinic, naphthenic, heavy fuel oils, biofuels, waste oils or such as esters, poly alpha olefins; etc, and mixtures thereof.

An important area of use for the new microemulsions is in the heavy duty diesel engine market, particularly trucks, buses and other heavy duty transport vehicles, where the engines of these vehicles are designed to use the emulsions as lubricants and coolants, rather than just as a fuel, although the present invention is not limited to this application area.

The present invention provides a composition for preparing an emulsion combining the cooling properties of the added water with the lubricity of the fuel continuous phase in such a manner that a stable clear translucent fluid is obtained. Whilst giving these benefits the emulsions of this invention exhibit none of the disadvantages associated with conventional fluids i.e. bacterial growth, corrosion, reduced stability etc.

The present invention may provide a stable microemulsion. By referring to the microemulsion of the present invention as being "stable", we mean that the water phase in the water-in-oil emulsion exists as dispersed droplets having an average particles size of no greater than 0.1 μm in the oil phase for at least 12 months when stored at a constant temperature of 25° C. without stirring. The microemulsion is of a continuous fuel phase in which water droplets, having an average droplet size of no greater than or <0.1 μm are dispersed. The resultant clear translucent microemulsion remains thermodynamically stable when used as a lubricant or coolant in a modern heavy duty diesel engine and further offers both high lubricity and improved combustion properties. The droplets in the water-in-oil emulsion of the present invention may be in the form of micelles.

The present invention may provide a high water content fluid that, due to the extremely small droplet size, cannot support microbial growth.

Other than in the operating examples, or where otherwise indicated, all numbers expressing quantities of ingredients used herein are to be understood as modified in all instances by the term "about".

The microemulsion of the present invention may be prepared from fuels that are standard grades available at any service station. Preferably, if the oil is a fuel oil, the fuel oil is selected from diesel, kerosene, gasoline/petrol (leaded or unleaded) and mixtures thereof.

The mixture ratios of the oil and water employed in the present emulsion can be varied depending on the application of the emulsion. Generally speaking, the oil comprises at least about 60%, more preferably at least about 70%, most preferably about 80% by weight, based on the total weight of the clear aqueous composition or emulsion. Generally speaking, the oil phase comprises no greater than about 95% by weight, and preferably no more than about 90% by weight.

Typically, the composition or microemulsion comprises from about 1 to about 30% by weight of emulsifier, preferably from about 1 to about 20%, and even more preferably from about 1 to about 10%. The emulsifier is most preferably a mixture of emulsifying agents selected to minimise the total amount of emulsifier required to form a microemulsion for a given fluid.

Where a compound is referred to as being "ethoxylated", we mean it includes at least 2 EO groups. Preferably ethoxylated compounds comprise from 2 to 12 EO groups. For example, suitable alcohol ethoxylated compounds include those with 2 to 5 EO groups, more suitably compounds with 2 to 3 EO groups When a mixture of $C_6$-$C_{15}$ alcohol ethoxylates is employed in the microemulsion, it is preferably a mixture of $C_9$-$C_{14}$ alcohol ethoxylates, such as a mixture of $C_9$ to $C_{11}$ alcohol ethoxylates or a mixture of $C_{12}$-$C_{14}$ alcohol ethoxylates. The distribution of any of the components in the mixture can range from 0 to 50% by weight, and are preferably distributed in a Gaussian format. Commercially available $C_6$-$C_{15}$ alcohol ethoxylates include relevant products sold under the trademarks Wickenol (available from Witco, England), Neodol (available from Surfachem, England), Dobanol (available from Shell, England), and Synperonic (available from ICI, England), although some of the products may not be exclusively from these ranges. An example of a commercial $C_{12}$-$C_{14}$ alcohol ethoxylate is Laoropal 2 (available from Witco, England).

In embodiment, the emulsifying agent comprises the following: (i) 2 parts by wt cocamidopropyl betaine; (ii) 95 parts by wt $C_9$-$C_{11}$ alcohol ethoxylate; and (iii) 3 parts by wt $C_{10}$ alkyl amine oxide.

In another embodiment, the emulsifying agent comprises the following: (i) 1 part by wt cocamidopropyl betaine; (ii) 8 parts by wt $C_9$-$C_{11}$ alcohol ethoxylate; (iii) 3 parts by wt $C_{10}$ alkyl amine oxide and iv) 90 parts nonionic fatty ($C_6$-$C_{24}$)acid amine ethoxylates comprising from about 2 to 20 EO groups.

In another embodiment, the emulsifying agent comprises the following: (i) 5 parts by wt cocamidopropyl betaine; (ii) 75 parts by wt $C_6$-$C_{15}$ alcohol ethoxylate; (iii) 10 parts by wt $C_{10}$ alkyl amine oxide and iv) 10 parts nonionic fatty ($C_6$-$C_{24}$) acid amine ethoxylates comprising from about 2 to 20 EO groups.

The emulsifying agents employed in the present invention are liquids at room temperature.

In one embodiment of the present invention, a microemulsion is prepared by mixing:

(a) about 5 to 40 parts, e.g. 10 parts, water;

(b) about 95 to 60 parts, e.g. 75 parts, oil, e.g. a diesel fuel oil; and (c) about 1 to about 30 parts, e.g. 15 parts, emulsifying agents, wherein the emulsifying agents include i) a fatty ($C_8$-$C_{24}$)-amido-($C_1$-$C_6$)alkyl betaine, ii) a $C_6$-$C_{15}$ alcohol ethoxylate comprising from 2 to 12 EO groups or a mixture of such alcohol ethoxylates, preferably the mixture, iii) a ($C_6$-$C_{24}$) alkyl amine oxide, and optionally iv) a nonionic fatty ($C_6$-$C_{24}$)acid amine ethoxylate comprising from about 2 to 20 EO groups, wherein all parts are by volume.

In another particular embodiment, the microemulsion is prepared by mixing: (i) 8 parts water; (ii) 75 parts a kerosene type fuel oil; and (iii) emulsifying agents as defined above, in amount of 17 parts by volume relative to the total oil and water.

In a further particular embodiment, the microemulsion is prepared by mixing: (i) 9 parts water; (ii) 75 parts a fuel oil; and (iii) emulsifying agents as defined above, in amount of 16 parts by volume relative to the total oil and water.

Whilst the emulsifying agents can be used in amounts of 1 wt % or more, in a further aspect of the invention the emulsifying agents can be added directly to the liquid fuel or oil at a level of less than 1% by weight with no deliberate addition of water. In this embodiment, the emulsifying agent(s) are used to scavenge free-water which may already be present in the fuel or oil as a contaminant from water drop-out or to scavenge free-water contaminant which may subsequently be introduced into the liquid fuel or oil e.g. by condensation.

The water used in the present invention can be taken directly from the local water supply, although to reduce potential contaminants de-ionised water may also be used.

The present invention may be utilised in, among others, diesel truck engines, oil burning heating systems and is suited to all uses within these application areas. Other uses within the fuels industry will be apparent to those skilled in the art.

The microemulsion may comprise additional components. These additional components may be incorporated to improve anti-wear, extreme pressure properties, improve cold weather performance or improve fuel combustion. The requirement to add additional components may be dictated by the application area in which the microemulsion is used.

Suitable additional components, and the requirement thereof depending on application area, will be apparent to those skilled in the art.

The present invention will now be further described by way of example.

EXAMPLES

Reference hereafter to "a water-in-oil microemulsion wherein the emulsion is a clear translucent emulsion" is believed to be analogous to "a water-in-oil emulsion, wherein the average droplet size of the water phase of the water-in-oil emulsion is no greater than 0.1 μm". In the present examples, the emulsions were visually inspected. Those which were clear were considered to have an average droplet size of the water phase of the water-in-oil emulsion of no greater than 0.1 μm.

In the following examples, all "parts" are parts by weight, unless stated otherwise.

Example 1

A composition suitable for combining oil with water was prepared by adding the following components in the quantities stated:

(i) 95 parts $C_9$-$C_{11}$ alcohol ethoxylate (Neodol); (ii) 3 parts amine oxide (Surfac CPO available from Surfachem); and (iii) 2 parts cocamidopropyl betaine.

The components were gently mixed to form an homogenous composition.

Example 2

A composition suitable for combining oil with water was prepared by adding the following components in the quantities stated:

(i) 90 parts amine ethoxylate (Alcosist ACP available from Allied Colloids, England); (ii) 8 parts $C_9$-$C_{11}$ alcohol ethoxylate (Genapol Z0309X available from Hoechst); and (iii) 1 part amine oxide ((Surfac CPO available from Surfachem)) and (iv) 1 part cocamidopropyl betaine.

The components were gently mixed to form an homogenous composition.

Example 3

A composition suitable for combining oil with water was prepared by adding the following components in the quantities stated:

(i) 75 parts $C_6$-$C_{15}$ alcohol ethoxylate (Laoropal 2 available from Witco, England); (ii) 10 parts fatty acid amine ethoxylate (Ciba's Albegal B product); and (iii) 10 parts amine oxide ((Surfac CPO available from Surfachem)) and (iv) 5 parts cocamidopropyl betaine.

The components were gently mixed to form an homogenous composition.

Example 4

10 parts by vol of the composition from Example 1 was used to combine 75 parts by vol of diesel base oil with 10 parts by vol water. The emulsifier composition was introduced to the oil and water from a burette. The resulting fluid was gently mixed until a clear translucent fluid was observed. The resulting fluid remains stable after more than one year.

Example 5

10 parts by vol of the composition from Example 2 was used to combine 75 parts by vol of kerosene base oil with 8 parts by vol water. The composition was introduced to the oil and water from a burette. The resulting fluid was gently mixed until a clear translucent fluid was observed. The resulting fluid remains stable after more than one year.

Example 6

10 parts by vol of the composition from Example 3 was used to combine 75 parts by vol of fuel base oil with 9 parts by vol water. The composition was introduced to the oil and water from a burette. The resulting fluid was gently mixed until a clear translucent fluid was observed. The resulting fluid remains stable after more than one year.

Example 7

The fluids from examples 4, 5 and 6 have all been subjected to industry standard tests for anti-wear properties (ASTM D6078 Sl-Bocle Test), microbial growth (Using standard dip slide techniques), corrosion (IP154) and anti-foaming properties (IP 146). All of the fluids demonstrated comparable anti-wear properties to the base fluid from which they were prepared. No microbial growth, corrosion or excessive foaming was observed in any of the fluids.

Example 8

The fluids from examples 4, 5 and 6 were subjected to evaluation of their combustion in relation to the base oil from which they were prepared. The fluids were either burnt using a standard home heating boiler and temperatures of the flue gases were monitored or tested on an engine test bed and again the exhaust gases monitored very accurately for temperature. In all cases the combustion temperature was significantly reduced in the microemulsions than the straight base fluids. This indicates that the fuel will burn at lower temperatures to give cleaner emissions by minimising the formation of oxides of both carbon and nitrogen.

Example 9

The fluids from examples 4, 5 and 6 were subjected to corrosion tests using aluminium and mild steel test material. This test is particularly relevant for fuels that are pumped using the inline system where the pumps are very sensitive to water. The aluminium and mild steel were immersed in the fluid and subjected to varying pressures and temperatures (up to 500 psi ($3.445\times10^6$ Pa) and 250° C.). In all cases no corrosion was observed on the test materials.

Example 10

A comparable test to that in example 9 was undertaken using a commercial invert macroemulsion. Corrosion was observed on the aluminium and mild steel test pieces.

Example 11

To demonstrate the ease with which the microemulsion fluids can be disposed a sample of waste material from a machine trial was used as a fuel oil. The waste material was combined with water and the composition of the present invention for use as material in a heating system. The fluid was used with no clean up and found to give no problems to the heating system.

Example 12

The microemulsion fluids prepared in the previous examples have been formed using all conventional base fluid types. These being:

All Standard Fuel Oil Types i.e. Diesel, Kerosene, Red Diesel, Unleaded Petrol Etc.
Mineral Oils
Biofuels
Naphthenic Oils
Paraffin Oils
Ester Oils
Glycol's
Synthetic Oils
Linear Alpha Hydrocarbons Example 13

A sample of the surfactant composition has been used to make a fuel using standard Ultra Low Sulphur Diesel (10 parts by vol composition, 100 parts by vol Diesel, 10 parts by vol water). This emulsion fuel has been used without incident in a standard diesel engine for over 3 months as part of a long term trial. No adverse affects have been noted and fuel consumption has not been affected.

Example 14

To evaluate the performance of water-in-fuel microemulsion forming surfactants to retain a fuel in a usable state after contamination with atmospheric moisture, 2 parts by vol. water was added to a domestic fuel oil (2 parts by vol. water: 98 parts by vol kerosene), thereby to simulate a fuel oil with a known high level of water contamination. 2 parts by vol. of the surfactant composition was added to the water/fuel mix with gentle mixing to form a clear water-in-fuel microemulsion. The modified fuel was then pumped into a static storage tank, vented to the atmosphere, located in a garden in the South West of England and exposed to atmospheric conditions for two years.

At regular intervals over the two year period, samples of the modified fuel oil were drawn from the bottom of the tank in a conventional manner. The fuel samples were evaluated and showed no signs of deterioration, such as visible signs of microbial growths or water stratification.

The performance of the aged fuel was also evaluated as a fuel in a fuel burning heating and cooking system, by drawing the fuel from the bottom of the tank in a conventional manner and feeding it to the cooker. The fuel was observed to burn more efficiently and had reduced harmful emissions than a conventional non-aged kerosene fuel oil.

An unmodified kerosene fuel oil held in a similar static storage tank over the same period of time and under the same atmospheric conditions, when drawn from the bottom of the tank in a conventional manner, would likely be observed to contain microbial growths and stratified water, thus rendering the aged fuel in the tank unsuitable for burning in the fuel burning system.

Example 15

To evaluate the performance of water-in-fuel microemulsion forming surfactants to retain a fuel in a usable state after contamination with atmospheric moisture, 2 parts by vol. deionised water was added to a domestic heating oil (2 parts by vol. water: 98 parts by vol kerosene), thereby to simulate a fuel oil with a known high level of water contamination. 2 parts by vol. of the surfactant composition was added to the water/fuel mix with gentle mixing to form a clear water-in-fuel microemulsion. The modified fuel was then pumped into a static storage tank, vented to the atmosphere, located in a garden in the South West of England and exposed to atmospheric conditions for over twelve months.

A second static tank of modified heating oil was also prepared based on 5 parts by vol. water/95 parts by vol. kerosene and 2 parts by vol surfactant composition.

At regular intervals over the three month period, samples of the modified fuel oil were drawn from the bottom of the two tanks in a conventional manner. The fuel samples were evaluated and all showed no signs of deterioration, such as visible signs of microbial growths or water stratification.

The performance of the aged fuels were also evaluated as a fuel in a 50/70 standard oil-fired boiler (output 20.5 kW (70,000 Btu/h), by drawing the fuels from the bottom of the tanks in a conventional manner and feeding them to the boiler. As indicated in Table 15 below, the fuels were observed to burn more efficiently and had reduced harmful emissions than a conventional non-aged kerosene fuel oil.

TABLE 15

Summary of efficiency data for Kerosene with 2% surfactant composition with 2% and 5% water contamination.

| Efficiency using Base fuel | Efficiency using Treated fuel | Increase in efficiency |
|---|---|---|
| 89.3% | With 2% water contamination: 90.7% | 1.4% points |
| 89.8% | With 5% water contamination: 92.0% | 2.2% points |

Various modifications and variations of the described methods and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. A method of scavenging free-water which is introduced as a contaminant into a liquid fuel or oil which is immiscible with water thereby to retain the liquid fuel or oil in a usable state, which method comprises:

i) adding to a substantially water-free liquid fuel or oil one or more surfactants which alone or together is/are a) miscible or soluble with both the liquid fuel or oil and water and b) capable of distributing free-water into the liquid fuel or oil to provide a stable clear water-in-oil microemulsion; and ii) allowing the at least one surfactant to mix with the liquid fuel or oil, wherein the liquid fuel or oil is stored within a vessel having a head-space vented to the atmosphere.

2. A method as claimed in claim 1, wherein said one or more surfactants comprises a fatty ($C_8$-$C_{24}$)-amido-($C_1$-$C_6$) alkyl betaine emulsifying agent.

3. A method as claimed in claim 2, wherein said one or more surfactants is a mixture of emulsifying agents comprising:

a. about 0.5 to about 15 wt % fatty ($C_8$-$C_{24}$)-amido-($C_1$-$C_6$)alkyl betaine, b. about 5 to about 99 wt % $C_6$-$C_{15}$ alcohol ethoxylate comprising from 2 to 12 EO groups or a mixture of such alcohol ethoxylates, preferably the mixture, c. about 0.5 to about 15 wt % ($C_6$-$C_{24}$)alkyl amine oxide and d. 0 or up to about 94 wt % other non-ionic emulsifying agent based on the total weight of emulsifying agent.

4. A method as claimed in claim 3, wherein the other non-ionic emulsifying agent is a nonionic fatty ($C_6$-$C_{24}$) acid amine ethoxylate comprising from about 2 to 20 EO groups.

5. A method for inhibiting the growth of aquatic microorganisms in a liquid fuel or oil which is immiscible with water thereby to retain the liquid fuel or oil in a usable state, which method comprises:

i) adding to a substantially water-free liquid fuel or oil one or more surfactants which alone or together is/are a) miscible or soluble with both the liquid fuel or oil and water and b) capable of distributing free-water into the liquid fuel or oil to provide a stable clear water-in-oil microemulsion; and ii) allowing the at least one surfactant to mix with the liquid fuel or oil;

wherein the liquid fuel or oil is stored within a vessel having a head-space vented to the atmosphere; and wherein said one or more surfactants comprises a fatty ($C_8$-$C_{24}$)-amido-($C_1$-$C_6$)alkyl betaine emulsifying agent.

6. A method as claimed in claim 5, wherein said one or more surfactants is a mixture of emulsifying agents comprising:

a. about 0.5 to about 15 wt % fatty ($C_8$-$C_{24}$)-amido-($C_1$-$C_6$)alkyl betaine;

b. about 5 to about 99 wt % $C_6$-$C_{15}$ alcohol ethoxylate comprising from 2 to 12 EO groups or a mixture of such alcohol ethoxylates, preferably the mixture;

c. about 0.5 to about 15 wt % ($C_6$-$C_{24}$)alkyl amine oxide; and d. 0 or up to about 94 wt % other non-ionic emulsifying agent based on the total weight of emulsifying agent.

* * * * *